United States Patent [19]

Schneider

[11] 4,435,126

[45] Mar. 6, 1984

[54] CENTRIFUGAL PUMP IMPELLER WITH REPLACEABLE WEAR RING

[75] Inventor: Wolfgang Schneider, Weisenheim, Fed. Rep. of Germany

[73] Assignee: Klein, Schanzlin & Becker Aktiengesellschaft, Frankenthal, Fed. Rep. of Germany

[21] Appl. No.: 245,190

[22] Filed: Mar. 18, 1981

[30] Foreign Application Priority Data

Mar. 26, 1980 [DE] Fed. Rep. of Germany ..... 3011675

[51] Int. Cl.[3] ..... F04D 29/22

[52] U.S. Cl. ..... 416/186 R; 416/224; 29/156.8 CF; 29/402.02

[58] Field of Search ..... 416/186 R, 186 A, 224, 416/245, 189, 195; 415/172 R, 172 A, 174; 29/156.8 CF, 402.02; 277/9, 9.5; 308/237 A

[56] References Cited

U.S. PATENT DOCUMENTS 1,327,812 1/1920 Exton ..... 416/224

3,822,963 7/1974 Goldberg ..... 416/245

FOREIGN PATENT DOCUMENTS 1284766 12/1968 Fed. Rep. of Germany ..... 277/9

728972 4/1955 United Kingdom ..... 416/224

*Primary Examiner*—Harvey C. Hornsby

*Assistant Examiner*—Christine A. Peterson

*Attorney, Agent, or Firm*—Kontler, Grimes & Battersby

[57] ABSTRACT

A centrifugal pump impeller, particularly for use in pumps for effecting forced circulation of contaminated fluids in the primary circuits of nuclear reactor plants, has an impeller body which is surrounded by a cylindrical wear ring. The wear ring has an exposed end face and a second end face which is adjacent to a circumferential shoulder of the impeller body. The second end face of the ring is formed with axially parallel bores or slots which extend toward but short of the first end face, and the shoulder has recesses which are aligned with the open ends of the adjacent bores or slots. The first end face of the ring is formed with markers in the form of notches which register with the corresponding bores or slots and allow for accurate positioning of a boring tool which is used to bore out the ring after a certain period of wear to facilitate its separation from the impeller body and replacement with a fresh wear ring. The ring can be secured to the impeller body by screws and/or by being shrunk onto the peripheral surface of the impeller body.

10 Claims, 5 Drawing Figures

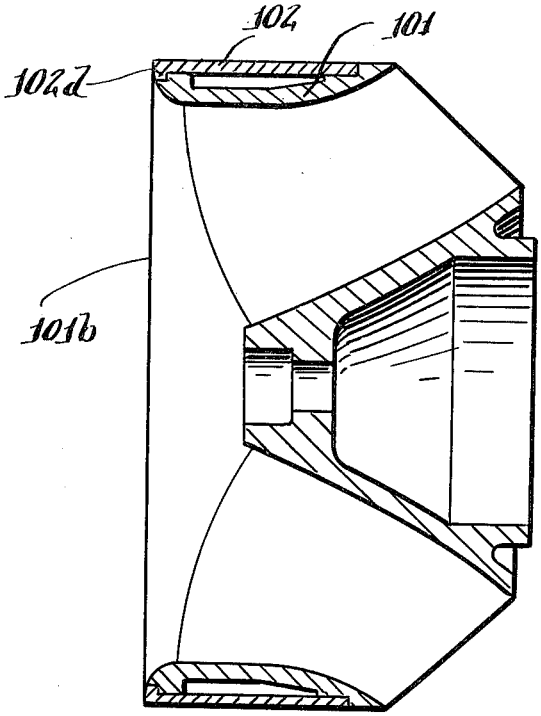
Fig. 1.
PRIOR ART
Fig. 2.
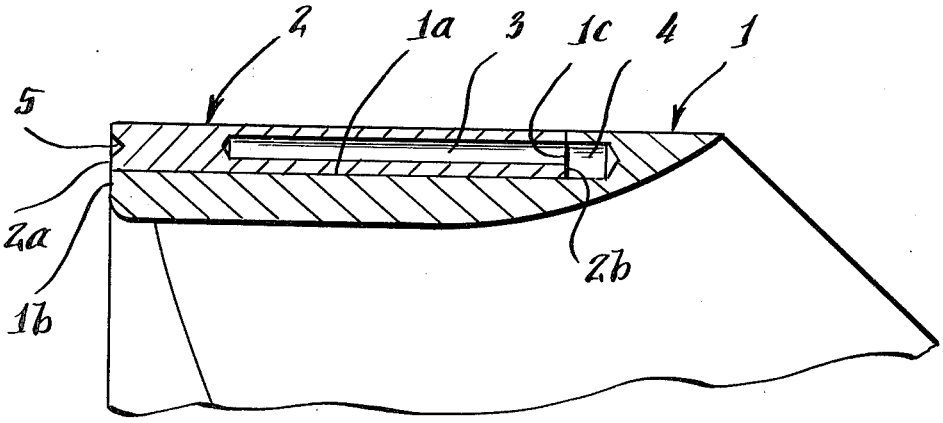

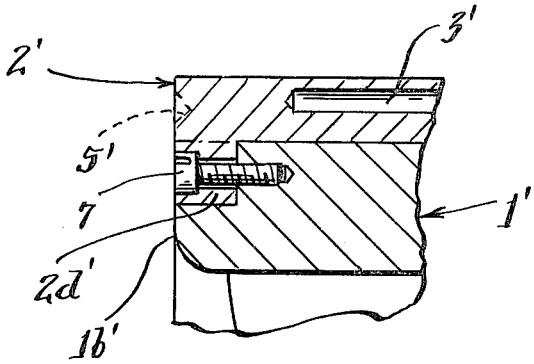
Fig. 4.
Fig. 3.
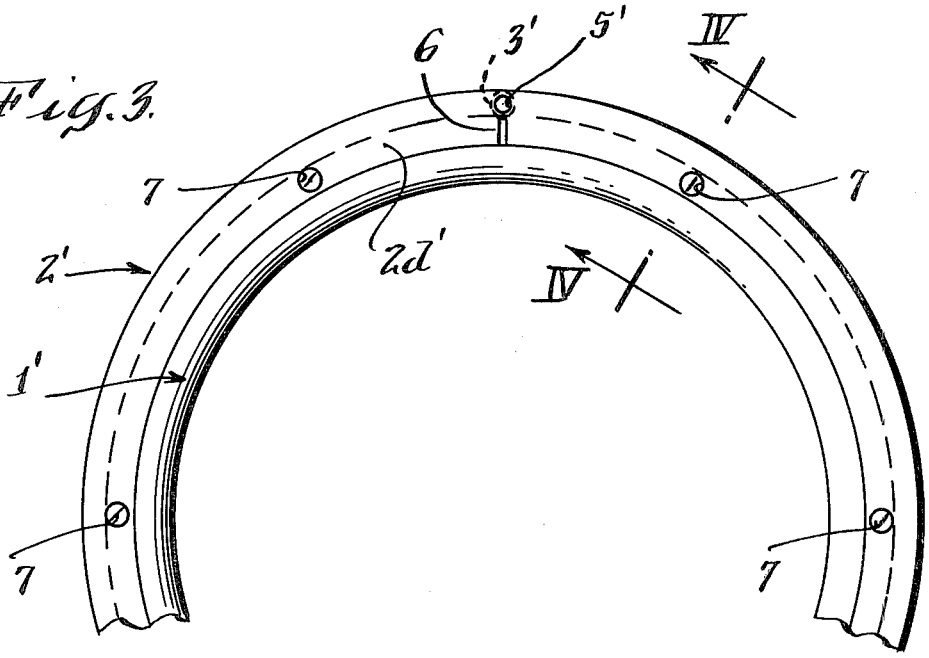
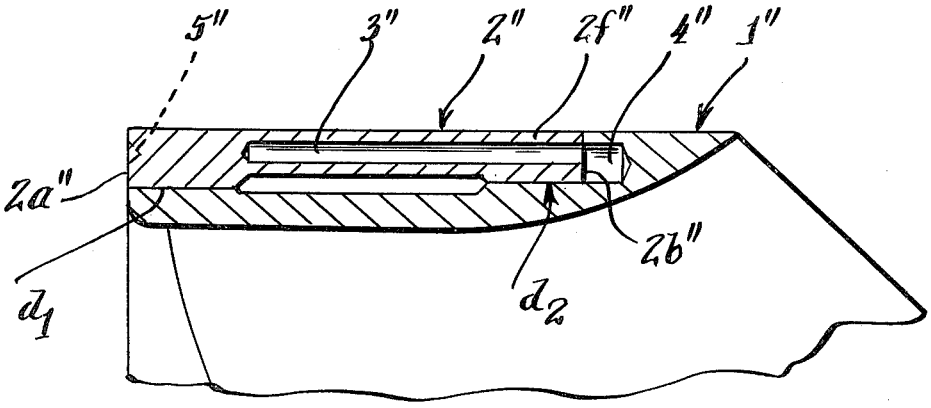
Fig. 5.

CENTRIFUGAL PUMP IMPELLER WITH REPLACEABLE WEAR RING

BACKGROUND OF THE INVENTION

The present invention relates to centrifugal pumps in general, and more particularly to improvements in impellers for use in centrifugal pumps, especially in centrifugal pumps which serve to effect forced circulation of contaminated fluids in the primary circuits of nuclear reactor plants. Still more particularly, the invention relates to improvements in centrifugal pump impellers of the type wherein the body of the impeller is surrounded by a wear ring which is shrunk onto and/or otherwise secured to the peripheral surface of the body.

It is already known to provide the impeller of a centrifugal pump with a wear ring which surrounds the periphery of and is normally shrunk onto the impeller body so that it must be destroyed in order to allow for separation from the body. It is also known to provide a wear ring with a flange or collar which overlies a portion of one end face of the impeller body and is separably secured to the latter. Still further it is known to employ in such impellers wear rings with cylindrical internal surfaces of constant diameter from end to end or with stepped cylindrical internal surfaces. When the need arises, a wear ring which has undergone a maximum permissible amount of wear must be detached from the impeller body and replaced with a fresh wear ring. The replacement involves treatment of the impeller in a suitable machine tool which removes the material of the spent or damaged wear ring preparatory to attachment of a fresh water ring. In some instances, the entire spent or damaged wear ring can be forcibly detached from the body of the impeller so that there is no need for removal of the material of the wear ring in a lathe or an analogous machine tool. As a rule, spare wear rings are held in storage in a condition such that a certain amount of their material must be removed by machining preparatory and/or subsequent to attachment to the body of an impeller. For example, a fresh water ring which is held in storage has an outer diameter exceeding the desired outer diameter of the composite impeller and an inner diameter which is smaller than required to allow for immediate application of such wear ring onto the body of an impeller.

When the pump which embodies an impeller of the above outlined character is used in the primary circuit of a nuclear reactor plant, the impeller is necessarily contaminated so that great care must be exercised during removal of a spent or damaged wear ring in order to confine the radiation and to avoid damage to the health of the workmen. In most instances, removal or replacement of a spent wear ring is preceded by a time-consuming, costly and complex decontamination which, in turn, is followed by removal of the material of the spent wear ring by resorting to a rotary material removing tool. Furthermore, a fresh wear ring must be applied to a radiation-emitting impeller body which involves additional substantial expenditures in connection with adequate shielding of attendants from radiation. Moreover, the replacement of a spent or damaged wear ring under the just outlined circumstances is cumbersome and contributes significantly to the maintenance cost of the entire reactor plant or any other installation in which the composite impeller is put to use.

OBJECTS AND SUMMARY OF THE INVENTION

An object of the invention is to provide a novel and improved wear ring for use in a composite impeller which can be installed in centrifugal pumps, especially in centrifugal pumps for use in nuclear reactor plants.

Another object of the invention is to provide a novel and improved impeller which embodies the above outlined wear ring and to provide a novel and improved impeller body which can be combined with the wear ring for use in a centrifugal pump.

A further object of the invention is to provide a novel and improved method of removing a spent or damaged wear ring from the peripheral surface of the body of a centrifugal pump impeller.

An additional object of the invention is to provide a wear ring which can be readily separated from the body of the impeller under circumstances which do not entail contamination of the surrounding atmosphere if the centrifugal pump which embodies the impeller is used in a nuclear reactor plant, especially in the primary circuit of a reactor plant.

Still another object of the invention is to provide a novel and improved mode of removing a wear ring which has been exposed to radiation from the body of a centrifugal pump impeller without damage to the body of the impeller.

An additional object of the invention is to provide a composite impeller wherein a damaged wear ring can be separated from the impeller body without damage to the latter and replaced with a fresh wear ring in a time-saving operation which does not necessitate resort to complex, bulky and specially designed machinery.

A further object of the invention is to provide a wear ring which can be used as a substitute for conventional wear rings on the bodies of centrifugal pump impellers, especially impellers for use in pumps which effect forcible circulation of contaminated fluids in nuclear reactor plants.

Still another object of the invention is to provide a wear ring which can be rapidly replaced with a fresh water ring so that the interval of exposure of personnel to radiation (if any) when the wear ring to be replaced is contaminated as a result of use of the respective pump in a nuclear reactor plant is reduced to a minimum.

A further object of the invention is to provide a wear ring which can be used as a substitute for spent or damaged wear rings and which is constructed and dimensioned in such a way that it can be placed onto the body of an impeller without any further machining.

Another object of the invention is to provide a wear ring which can be detached from the body of an impeller by persons or devices located at a considerable (safe) distance from the impeller so that the fact that the damaged ring is or may be contaminated does not affect the health of the person or persons in charge of replacement.

A further object of the invention is to provide a wear ring which can be detached from the body of an impeller in such a way that the body is not damaged as a result of or during replacement and is immediately ready for assembly with a fresh wear ring, particularly with a fresh wear ring which is constructed and dimensioned in such a way that it can be applied to the periphery of the impeller body without any machining or without appreciable machining of the impeller body and/or of the fresh wear ring.

The invention is embodied in an impeller for use in centrifugal pumps, particularly in pumps for effecting forced circulation of contaminated fluids in nuclear reactor plants. More specifically, the invention resides in the provision of an impeller which comprises an impeller body having a peripheral surface, and a wear ring which surrounds the peripheral surface of the impeller body and has an exposed end face, a second end face which is preferably adjacent to a circumferential shoulder of the impeller body, a plurality of axially parallel elongated sockets in the form of slots or bores provided in the second end face and extending toward but short of the first end face, and indices (e.g., notches) provided in or on the first end face of the wear ring in register with the sockets so that a drill or another material removing tool can be caused to penetrate into the sockets by placing the tip of the tool into register with such sockets with assistance from the respective indices. The shoulder of the impeller body can be provided with recesses (e.g., blind bores) in axial alignment with the open ends of the sockets in the second end face of the wear ring so as to reduce the likelihood of damage to the impeller body during certain stages (e.g., the last stage) of separation of a spent or damaged wear ring from the body of the impeller.

The wear ring is preferably shrunk onto the peripheral surface of the impeller body. In addition to such shrinking, the wear ring can be provided with an internal collar or flange in the region of the first end face, and the impeller then comprises screws, bolts or analogous fastener means for securing the flange or collar to the impeller body. The first end face of the wear ring is or may be at least substantially coplanar with an end face of the impeller body, and the wear ring may have two sockets which are disposed diametrically opposite each other.

The wear ring can have a composite internal surface with a larger-diameter portion which is adjacent to the second end face and a smaller-diameter portion which is adjacent to the first end face of the wear ring.

The novel features which are considered as characteristic of the invention are set forth in particular in the appended claims. The improved impeller itself, however, both as to its construction and the mode of assembling or dismantling the same, together with additional features and advantages thereof, will be best understood upon perusal of the following detailed description of certain specific embodiments with reference to the accompanying drawing.

BRIEF DESCRIPTION OF THE DRAWING

FIG. 1 is an axial sectional view of a conventional impeller with a wear ring shrunk onto the peripheral surface of its body;

FIG. 2 is a fragmentary axial sectional view of an impeller which embodies one form of the invention and wherein the wear ring is also shrunk onto the impeller body;

FIG. 3 is a fragmentary end elevational view of an impeller which is constructed and assembled in accordance with a second embodiment of the invention and whose wear ring has an inwardly extending annular flange which is secured to the body of the impeller by threaded fastener means;

FIG. 4 is a fragmentary axial sectional view as seen in the direction of arrows from the line IV—IV of FIG. 3; and FIG. 5 is a fragmentary axial sectional view of an impeller which is constructed and assembled in accordance with a further embodiment of the invention.

DESCRIPTION OF THE PREFERRED EMBODIMENTS

FIG. 1 illustrates a conventional impeller having a wear ring 102 which is shrunk onto the peripheral surface of the impeller body 101. The problems which arise when the wear ring 102 is to be separated from the impeller body were pointed out hereinbefore. The left-hand end portion of the wear ring 102 has a collar or flange 102*d* which is recessed into the left-hand end face 101*b* of the impeller body 101.

FIG. 2 shows a portion of an impelled which is constructed and assembled in accordance with one embodiment of the invention. The body 1 of the impeller has a peripheral surface l*a*, an end face l*b* and a circumferentially complete shoulder l*c*. The wear ring 2 has a first or exposed (accessible) end face 2*a* which is flush with the end face l*b*, a second end face 2*b* which is adjacent to the shoulder l*c*, and a plurality of elongated axially parallel sockets 3 which are open at the end face 2*b* and extend toward but short of the end face 2*a*. The sockets 3 are bores whose axes are located midway between the external and internal surfaces of the wear ring 2. In addition, the end face 2*a* of the wear ring 2 is formed with markers or indices 5 (e.g., relatively shallow circular notches bounded by conical surfaces) each of which is in register with a socket 3. The open ends of the sockets 3 are aligned with recesses 4 (e.g., blind bores) in the shoulder l*c* of the impeller body 1. The ring 2 is shrunk onto the peripheral surface l*a* of the body 1.

In accordance with a presently preferred embodiment of the invention, the ring 2 has two sockets 3 which are disposed diameterically opposite each other, i.e., the shoulder l*c* is also formed with two recesses 4 and the end face 2*a* is also formed with two markers 5. However, it is equally within the purview of the invention to form the wear ring 2 with three or more equidistant or otherwise distributed axially parallel sockets which may be blind bores, slots, slits, grooves or the like. An advantage of sockets in the form of bores is that they allow for accurate and convenient centering of the drill which is used to effect separation of the ring 2 from the impeller body 1. The tip of such drill is placed into the corresponding marker 5 and is thereupon driven into the registering socket or bore 3. The recesses 4 in the shoulder l*c* can be formed by milling, turning, boring or other suitable machinery. The provision of recesses 4 reduces the likelihood of damage to the body 1 (which is to be reused) during removal or separation of a damaged or spent wear ring 2. The markers 5 are machined into the end face 2*a* of a freshly finished wear ring 2 so that they are in accurate register with the respective sockets 3 before the ring is applied to the body 1.

FIGS. 3 and 4 illustrate a modified impeller wherein the impeller body 1' has a circumferential groove which is machined into the end face l*b'* for an inwardly extending flange 2*d'* of the wear ring 2'. The flange 2*d'* has radially extending slits 6 (only one shown) which are adjacent to the markers 5'. These markers, in turn, register with sockets (not specifically shown) corresponding to the socket 3 of FIG. 2. Thus, when a bore of sufficient diameter is drilled by a tool whose tip has been inserted into a marker 5, the wear ring 2' is split all the way to the shoulder (not shown) of the impeller body 1' because such bore communicates with the respective slit 6. The reference characters 7 denote several screws or analogous threaded fasteners which secure the flange 2d' to the body 1'. The depth and diameter of each socket, as well as the number of sockets, in the wear ring 2 or 2' is selected in dependency on the desired strength characteristics of the wear ring.

FIG. 5 illustrates a third embodiment of the improved impeller wherein the internal surface of the wear ring 2" has a first or thicker portion 2e" which is nearer to the end face 2a" and a second or thinner portion 2f" nearer to the end face 2b". In all other respects, the impeller of FIG. 5 is identical with that of FIG. 2 and similar parts are denoted by the same reference characters plus two primes. The larger inner diameter of the internal surface of the wear ring 2" is shown at $d_2$, and the smaller inner diameter of such surface is shown at $d_1$.

An important advantage of the improved impeller is that the wear ring 2, 2' or 2" can be readily separated from the body 1, 1' or 1" in a simple and time-saving manner. The person or persons in charge are exposed to minimal amounts of radiation, and the separation can be effected while the impeller including the wear ring 2, 2' or 2" is held under water which further reduces the amount of radiation that reaches the person or persons in charge.

Since the separation can be effected by the simple expedient of drilling bores of requisite diameter from the indices or markers 5, 5' or 5" toward the shoulder of the respective impeller body 1, 1' or 1", there is no need for costly and time-consuming stepwise removal of material of the spent wear ring, such as by turning, milling, grinding or an analogous material removing operation. The absence of milling or an analogous material-removing treatment further reduces the likelihood of damage to the impeller body during removal of a spent wear ring so that a fresh wear ring can be applied immediately upon completed removal of the preceding ring, i.e., with no machining of the body 1, 1' or 1" between the removal of a preceding ring and the application of the next-following ring. Removal of a spent or damaged wear ring by the formation of shavings is a time-consuming operation which is especially undesirable when the material of the ring to be removed was contaminated in actual use of the impeller. As mentioned above, the stability of a fresh wear ring can be selected in advance by making therein a given number of sockets, by properly selecting the diameters or other dimensions of the sockets (such as the axial length of the sockets and the width of the sockets if the sockets are slots rather than bores) and/or by properly selecting other parameters, such as the material of which the wear rings are made. As a rule, a fresh wear ring will be shrunk onto the peripheral surface of the impeller body. However, and especially if the wear ring has a flange of the type shown at 2d' in FIGS. 3 and 4, it may suffice to secure the ring 2' to the body 1' by resort to a requisite number of threaded fasteners. If the sockets are symmetrically distributed along the peripheral surface of the impeller body, the impeller or its body is adequately balanced not only prior to removal of a spent or damaged wear ring but also subsequent to the application of a fresh ring. This also reduces the amount of time which elapses during removal of a spent ring and the application of a fresh ring because the workers need not spend any time for balancing of the fully assembled impeller.

The fact that the wear ring 2" of FIG. 5 has an internal surface with two portions of different diameters is of no consequence insofar as the removal of the ring 2" is concerned because one can readily employ two different drills one of which is used to cut through the material of the outer portion 2e" of the ring 2" (nearer to the end face 2a") and the other of which is used to cut through the remaining portion 2f" of the ring 2" all the way to the shoulder of the body 1".

The feature that the wear ring is formed with sockets during manufacture, i.e., prior to mounting around the peripheral surface of the body of an impeller, greatly simplifies and shortens the separating operation. In other words, instead of it being necessary to cut all the way across the wear ring from the outer to the inner end face thereof, one can simply select the markers 5, 5' or 5" and drill bores of requisite diameter through such markers in parallelism with the axis of the impeller to thereby sever the ring all the way to the shoulder of the impeller body. The drill can be manipulated from a considerable distance, i.e., from a locus which is remote from the markers, so that the workmen manipulating the drill or drills are even less likely to suffer damage to their health as a result of potential exposure to radiation. A skilled or even semiskilled worker who is familiar with his or her tools can readily separate a spent or damaged wear ring without causing any damage to the impeller body so that the latter is ready for connection with a fresh ring as soon as the removal of the previously applied ring is completed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An impeller for use in centrifugal pumps, particularly in pumps for effecting forced circulation of fluids in primary circuits of nuclear power plants, comprising an impeller body having a peripheral surface; and a wear ring adapted to be readily removed from said impeller body, said ring surrounding said surface and having an exposed end face, a second end face, a plurality of elongated axially parallel sockets provided in said second end face and extending toward said first end face, and indices provided on said first end face in axial alignment with said sockets so that a material removing tool, such as a drill, can be caused to penetrate into said sockets by placing it into register with such sockets with the aid from the respective indices for ready removal of said wear ring from said impeller body.

2. The impeller of claim 1, wherein said sockets are bores.

3. The impeller of claim 1, wherein said sockets are slots.

4. The impeller of claim 1, wherein said body has a circumferential shoulder adjacent to said second end face and a plurality of recesses in said shoulder, each of said recesses being axially aligned with a discrete socket.

5. The impeller of claim 1, wherein said wear ring is shrunk onto said peripheral surface.

6. The impeller of claim 1, further comprising threaded fastener means extending in parallelism with said sockets and securing said wear ring to said body.

7. The impeller of claim 1, wherein said surface has a larger-diameter portion nearer to one of said end faces and a smaller-diameter portion nearer to the other of said end faces.

8. The impeller of claim 1, wherein said indices are notches machined into said first end face.

9. The impeller of claim 1, wherein said body has an end face which is at least substantially coplanar with the first end face of said wear ring.

10. The impeller of claim 1, wherein said wear ring has two sockets disposed diametrically opposite each other.

* * * * *